United States Patent [19]

Belvederi

[11] Patent Number: 4,741,350

[45] Date of Patent: May 3, 1988

[54] METHOD FOR PRODUCING CIGARETTES CONTAINING AT LEAST TWO DIFFERENT TOBACCO MIXTURES

[75] Inventor: Bruno Belvederi, San Martino Di Monte S. Pietro, Italy

[73] Assignee: G. D. Societa per Azioni, Bologna, Italy

[21] Appl. No.: 927,922

[22] Filed: Nov. 6, 1986

[30] Foreign Application Priority Data

Nov. 19, 1985 [IT] Italy ..... 3612 A/85

[51] Int. Cl.[4] ..... A24C 5/14

[52] U.S. Cl. ..... 131/84.3

[58] Field of Search ..... 131/84.1, 84.3, 84.4, 131/108, 110, 61.1

[56] References Cited

U.S. PATENT DOCUMENTS

| | | | |
|---|---|---|---|
| 3,237,628 | 3/1966 | Riegger | 131/83.1 |
| 3,795,249 | 3/1974 | Cristiani | 131/84.4 |
| 3,854,486 | 12/1974 | Molins et al. | 131/61.1 |
| 3,854,487 | 12/1974 | Molins et al. | 131/61.1 |
| 4,009,722 | 3/1977 | Wahle et al. | 131/84.4 |
| 4,516,585 | 5/1985 | Pinkham | 131/84.3 |
| 4,605,013 | 8/1986 | Goldbach | 131/84.1 |
| 4,616,622 | 10/1986 | Hartmann et al. | 131/84.1 |

*Primary Examiner*—V. Millin

*Attorney, Agent, or Firm*—Ladas & Parry

[57] ABSTRACT

A cigarette is formed by means of a single transfer device which both removes tobacco from a tobacco stream on a conveyor belt and then redeposits the same tobacco on the same stream. The spaces formed by the removal step are then filled with a second tobacco mixture.

11 Claims, 2 Drawing Sheets

METHOD FOR PRODUCING CIGARETTES CONTAINING AT LEAST TWO DIFFERENT TOBACCO MIXTURES

BACKGROUND OF THE INVENTION

1. Field of the Invention

This invention relates to a method for producing cigarettes containing at least two different tobacco mixtures.

2. Description of the Related Art

It is well known that the use of a single tobacco mixture for producing cigarettes can lead to certain drawbacks in that, for example, in a cigarette that tobacco portion furthest from the lit end behaves as a filter during cigarette combustion, and retains the combustion products to give the final part of the cigarette a taste which gradually differs from that of the initial part.

In order to adjust the aforesaid characteristics at will, it has been proposed to manufacture cigarettes using several tobacco mixtures located in different cigarette zones so that the said characteristics become influenced in a required and determined manner during the cigarette combustion time.

To obtain cigarettes of this type, manufacturing machines have been proposed having a suction belt conveyor to which two tobacco layers of different types are fed in succession and disposed one on the other by two ascending shafts. Pneumatic means are associated with a portion of the suction conveyor which communicates with the first shaft in order to periodically inhibit deposite of tobacco of the first type, so that on said conveyor portion there forms a first discontinuous tobacco layer, of which those zones free from tobacco are then filled with tobacco of the second type by the second shaft. Trimmer means disposed downstream of the second shaft along the path of said conveyor then make the thickness of the overall tobacco layer obtained uniform.

It has however been found that manufacturing machines of the aforesaid type are not able to produce cigarettes which are exactly equal to each other, ie containing constant proportions of the two tobacco mixtures, this being attributable to the fact that because of the fibrosity of the treated tobacco the said pneumatic means are not able to precisely and uniformly define the tobacco-free zones of the first layer, which therefore have dimensional differences which influence the cigarette characteristics.

Another type of manufacturing machine able to produce cigarettes of the described type is known, in which two ascending shafts disposed one following the other successively feed a suction belt conveyor with two continuous layers of tobacco of different types.

At the outlet of the first shaft, a trimmer device removes equidistant tobacco portions from the first layer to create spaces which are then filled with tobacco of the second type by the second shaft. A second trimmer device disposed downstream of the second shaft along the path of said conveyor then makes the thickness of the overall tobacco layer obtained uniform. A drawback of manufacturing machines of this type is that the two said trimmer devices trim away a large quantity of tobacco, which is known to result in considerable quality loss.

SUMMARY OF THE INVENTION

The object of the present invention is to provide a method for producing cigarettes containing at least two different tobacco mixtures, which does not give rise to the described drawbacks of the known art.

Said object is attained according to the present invention by a method for producing cigarettes containing at least two different tobacco mixtures, and is comprised of the following steps:

feeding a first tobacco mixture onto a belt conveyor to form a substantially continuous layer having a thickness less than that of a tobacco layer for forming a continuous cigarette rod;

by means of a transfer device, successively withdrawing from said layer tobacco portions the central zones of which are spaced apart by a distance equal to a multiple of the length of one cigarette;

by means of said transfer device, depositing said tobacco portions onto the tobacco remaining on said belt conveyor to form a succession of tobacco parts distributed at constant pitch;

feeding a second tobacco mixture onto said belt conveyor to fill the zones between said tobacco parts;

trimming the composite layer obtained by means of a trimmer device, operating in determined phase relationship with said transfer device, in order to make its thickness uniform; and wrapping said composite layer in paper to form a continuous cigarette rod.

BRIEF DESCRIPTION OF THE DRAWINGS

The present invention is described hereinafter by way of nonlimiting example with reference to the accompanying drawings in which.

DESCRIPTION OF THE PREFERRED EMBODIMENTS

Figure 1:
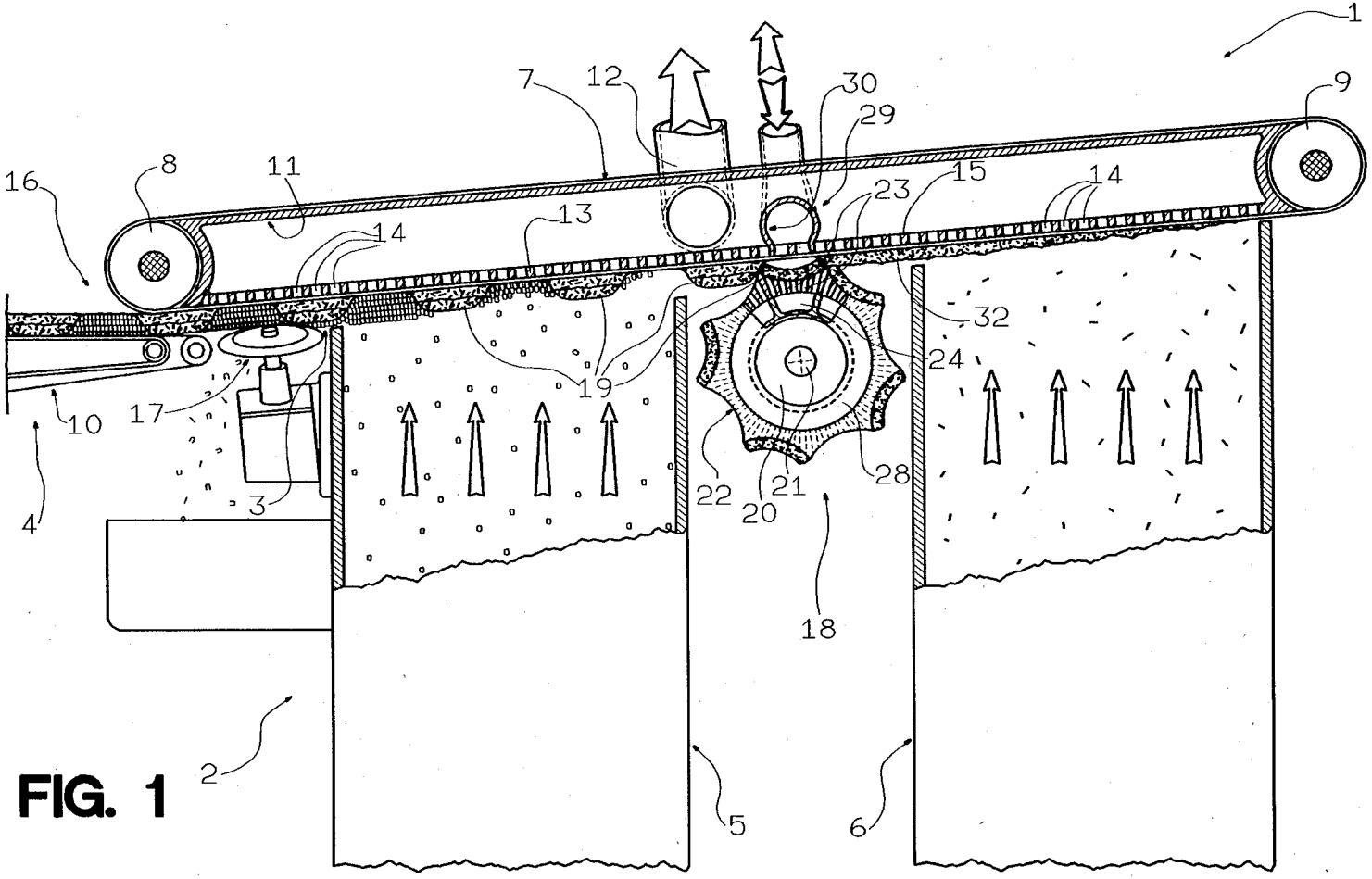
FIG. 1 is a diagrammatic front view of part of a cigarette manufacturing machine constructed in accordance with the present invention.

In FIG. 1, the reference numeral 1 indicates overall a cigarette manufacturing machine of the continuous rod type. The machine 1 comprises a section 2 for forming a tobacco layer 3 and a section 4 for wrapping said layer 3 in paper to form a continuous cigarette rod (not shown), to be then cut by a cutter device (also not shown) to form individual cigarettes. The section 2 comprises two ascending shafts, indicated by 5 and 6 from left to right in FIG. 1, which are disposed side-by-side and spaced apart by a determined distance for reasons stated hereinafter, above them there being disposed a suction belt conveyor 7 which passes around clockwise-rotating end rollers 8 and 9.

That end of the conveyor 7 disposed to the left in FIG. 1 lies above a device 10 for forming a continuous cigarette rod (not shown) and forming part of the section 4.

Within the loop defined by the belt conveyor 7 there is provided a chamber 11, connected by a pipe 12 to a suction source, not shown, and defined lowerly by a wall 13 which is air-permeable over its entire surface by virtue of the presence in it of a plurality of perforations 14.

The lower branch 15 of the conveyor 7, sliding in contact with the wall 13, closes the upper ends of the shafts 5 and 6, and its left hand end extends to a position 16, defined as the loading position, at which the conveyor 7 feeds the tobacco layer 3 to the forming device 10.

In proximity to the branch 15, downstream of the shaft 5 with reference to the direction of movement of the layer 3 and upstream of the loading position 16, there is provided a trimmer device 17 of known type able to make the thickness of the layer 3 retained by suction by the branch 15 uniform.

Between the shafts 5 and 6 there is located a transfer device 18 which, as described hereinafter, is able to remove tobacco portions 19 from determined zones of the tobacco layer formed on the branch 15 by the shaft 6 and to deposit them in different zones of the said layer. The device 18 comprises a rotary element 20, which is supported and driven, at a peripheral speed equal to that of the conveyor belt 7 but in an anticlockwise direction, by a horizontal shaft 21.

Figure 2:
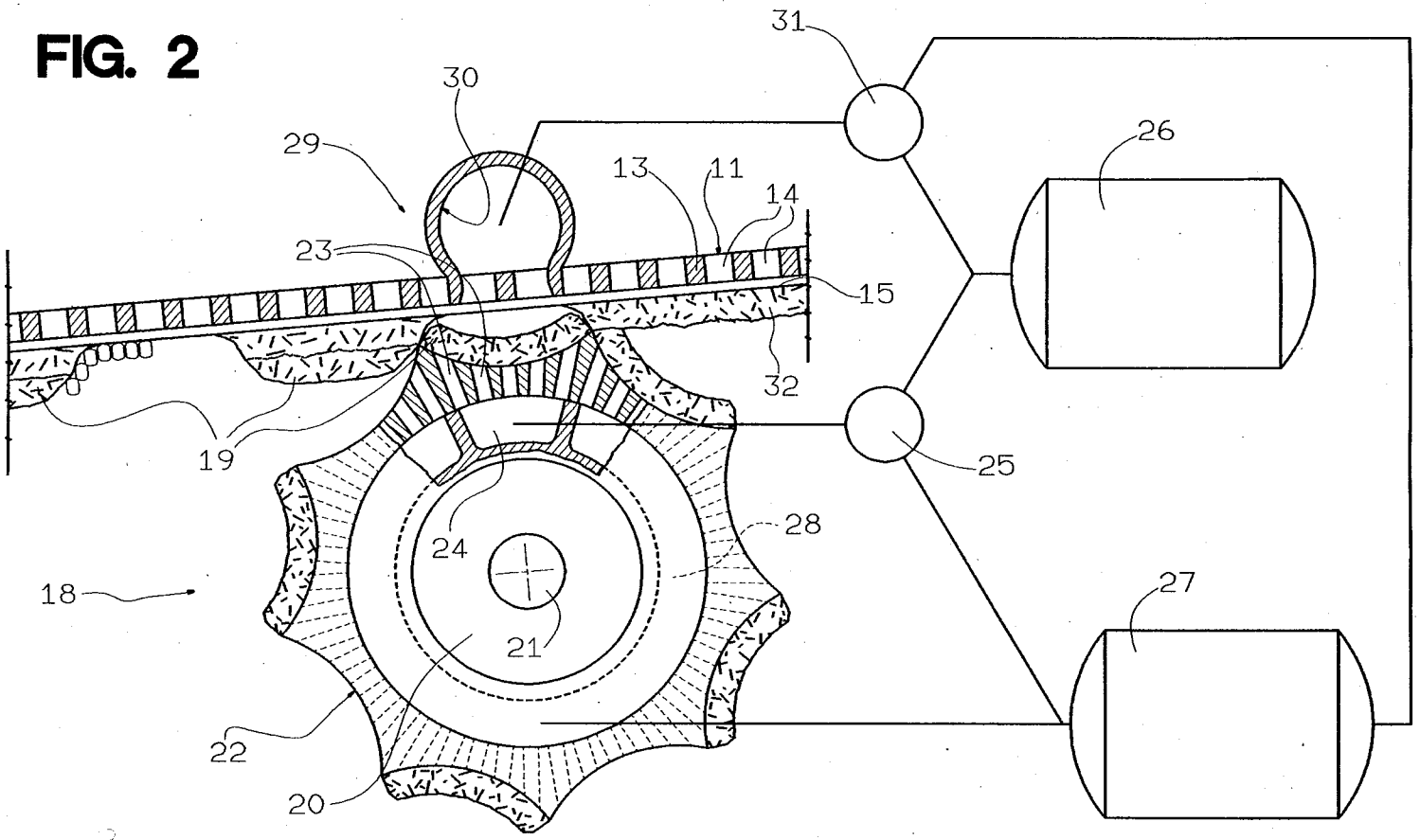
FIG. 2 shows a detail of FIG. 1 to an enlarged scale.

The element 20 is of substantially cylindrical shape, and is provided on its periphery with an odd number of equidistant recesses 22 (nine in the illustrated example) adjacent to each other. The recesses 22 have an arched base surface provided with a plurality of perforations 23 which communicate, in correspondence with the zone in which the element 20 is substantially tangential to the tobacco conveyed by the branch 15 of the conveyor 7, with a fixed chamber 24 inside the element 20 and communicating with a distributor valve 25 able to connect the perforations 23 of each recess 22, on reaching said zone, to a compressed air source 26 and to a suction source 27 in turn (see also FIG. 2).

There is provided in the element 20 a fixed chamber 28 permanently in communication with said suction source 27 and facing the perforations 23 of those recesses 22 disposed outside said tangential zone.

In the chamber 11, above the transfer device 18, there is provided a removal device 29 able to cooperate with the rotary element 20 to remove said tobacco portions 19 from the belt conveyor 7. The removal device 29 comprises pneumatic means formed from a chamber 30 provided above the wall 13 and communicating with interruption means comprising a distributor valve 31 able to connect the chamber 30 to the compressed air source 26 and to the suction source 27 in turn.

The distributor valves 25 and 31, preferably in the form of rotary valves, are driven in known manner, in determined phase relationship with the rotation of the element 20, by respective cyclically rotating shafts, not shown, forming part of the manufacturing machine 1.

When the machine 1 is operating, means of known type, not shown, feed respective continuous streams of tobacco particles of different type to the lower ends of the shafts 5 and 6. The particles of the first stream, under the thrust of an ascending air stream generated by a compressed air source, not shown, rise through the shaft 6 and adhere to the branch 15 to form by accumulation a continuous tobacco layer 32 of substantially uniform thickness equal to one half the thickness of the tobacco layer 3 to be subjected to the action of the trimmer device 17, as described hereinafter.

Externally to the shaft 6, the tobacco layer 32 adhering to the branch 15 reaches said substantially tangential zone between the transfer device 18 and belt conveyor 7. In this zone, alternate recesses 22 of the rotary element 20 successively withdraw from the layer 32 successive tobacco portions 19 having their central zones spaced apart by a distance equal to the length of two cigarettes produced by the manufacturing machine 1, by virtue of the fact that the chamber 24 becomes connected to the suction source 27 by way of the distributor valve 25 when each recess 22 filled with the tobacco portion 19 passes into said zone. The removal of each tobacco portion 19 from the layer 32 is facilitated by an air blast emitted by the removal device 29, by virtue of the operation of the distributor valve 31, as each of said recesses 22 passes into the said tangential zone. During the time between two successive removals of portions 19 from the layer 32, the valve 25 keeps the chamber 30 constantly connected to the suction source 27.

When a recess 22 containing a tobacco portion 19 returns to said tangential zone by a 360° rotation of the element 20, the said chamber 24 is connected by the valve 25 to the compressed air source 26, and the tobacco portion 19 contained in the recess 22 is deposited on the layer 32.

The tobacco layer adhering to the branch 15 of the conveyor 7 immediately upstream of the shaft 5 is therefore composed, by virtue of the described action of the devices 18 and 29, of portions free from tobacco which alternate with portions or parts of tobacco of the first type having a thickness double that of the layer 32.

Downstream of the transfer device 18, the tobacco layer 32 thus composed transits over the upper end of the shaft 5, and its said tobacco-free portions are filled with tobacco of the second type. When the tobacco layer 3 leaves the shaft 5, the trimmer device 17 regularises in known manner the thickness of the composite tobacco layer obtained, which, in correspondence with said loading position 16, is then discharged by the conveyor 7 onto the forming device 10 to be wrapped in known manner in a paper web. The continuous cigarette rod thus obtained is then cut, in the central zones of the portions 19, by a cutter device (not shown) operating in determined phase relationship with the transfer device 18 and with the trimmer device 17. In this manner, cigarettes are produced containing two separate tobacco mixtures.

In a manner analogous to that described, it would obviously be possible to obtain cigarettes composed of three or more cigarette mixtures. For this purpose, it would be necessary to provide a section 2 comprising three or more ascending shafts analogous to the shafts 5 and 6 and disposed in succession, with a transfer device analogous to the device 18 interposed between one and the next.

The device 18 could operate in a sufficiently effective manner on the tobacco layer 32 even without the presence of the removal device 29, which could therefore also be dispensed with in the section 2.

Alternatively, the removal device 29 could be not connected to the compressed air source 26. In this case, during withdrawal of the tobacco portions 19 by the transfer device 18, the valve 31 will have the exclusive function of interrupting connection between the chamber 30 and suction source 27, thus also facilitating removal of said portions 19 from the branch 15 of the conveyor 7.

I claim:

1. A method for producing cigarettes containing at least two different tobacco mixtures, comprising the following steps:

feeding a first tobacco mixture onto a conveyor belt to form a substantially continuous layer having a thickness less than that of a tobacco layer for forming a continuous rod;

by means of a transfer device, successively withdrawing from said layer tobacco portions which measured centrally from said portions are spaced apart by a distance equal to a multiple of the length of one cigarette;

depositing said tobacco portions by means of said transfer device onto the tobacco remaining on said conveyor belt to form a succession of tobacco parts distributed at constant pitch;

feeding a second tobacco mixture onto said conveyor belt to fill the areas left vacant through said withdrawing step between said tobacco parts which remained on said conveyor belt after said withdrawing step;

trimming with a trimmer device the composite layer to make said composite layer's thickness uniform, said trimmer device operating in determined phase relationship with said transfer device; and wrapping said composite layer in paper to form a continuous cigarette rod.

2. A cigarette producing machine comprised of:

an air permeable conveyor belt which circulates in a first direction;

a suction means associated with said conveyor belt;

a first tobacco containment means having at least one open end, said open end lying near said conveyor belt such that as said conveyor belt passes by said open end said suction means acts to suck at least some of the contents of said containment means against said conveyor belt, said conveyor belt then carrying said contents sucked against it beyond said open end and said containment means;

a transfer device for removing portions of said contents sucked against said conveyor belt and placing it on top of the remaining portions of said contents sucked against said conveyor belt that were not removed, the transfer device thereby leaving exposed sections of said conveyor belt between said portions of said contents that were not removed.

3. The cigarette producing machine as claimed in claim 2, wherein said transfer device comprises a rotary element which rotates in a second direction opposite said first direction, said rotary element having on its periphery an odd number of mutually adjacent recesses each having an air-permeable base surface; and wherein said cigarette producing machine further comprises:

compressed air source associated with said transfer device; and distribution means being provided for connecting said base surfaces of said recesses to said suction means and to said compressed air source in turn such that said suction means acts to suck said contents from said first containment means adhering to said conveyor into said recesses, said compressed air source acting to blow said contents held in said recesses onto said contents held by said conveyor means that were not removed.

4. The cigarette producing machine as claimed in claim 3 further comprising removal means which cooperate with said transfer device for facilitating the removal of said portions of said contents sucked against said conveyor belt to said transfer device; said removal means comprising cyclically operated means for interrupting connection between said suction source and said conveyor belt in correspondence with said exposed sections.

5. The cigarette producing machine as claimed in claim 4, wherein said removal means comprise pneumatic means able to act on the tobacco carried by said conveyor; and a distributor valve arranged to connect said pneumatic means to said suction means and to said compressed air source in turn.

6. The cigarette producing machine of claim 3 further comprising:

a second tobacco containment means having an open end near said conveyor belt, said transfer device being situated between said two containment means, said suction means causing at least some of the contents of said second containment means to adhere to at least said exposed sections of said conveyor belt.

7. The cigarette producing machine of claim 6 further comprising:

continuous supply means for continuously supplying contents to said first and second containment means; and air supply means associated with said first and second containment means for blowing said contents of said containment means toward said conveyor belt.

8. The cigarette producing machine of claim 6 further comprising:

trimming means located next to said second containment means, said trimming means acting to level off said contents held against said conveyor belt after it has passed beyond said first and second containment means such that said contents emerging from said trimmer consists of alternating portions located adjacent one another of said contents from said first container and said contents from said second container.

9. A method for producing cigarettes containing at least two different tobacco mixtures, said method comprising the steps of:

feeding a first tobacco mixture onto a conveyor means to form a substantially continuous first layer;

removing in succession spaced portions of said continuous first layer leaving spaced non-removed portions of said continuous first layer on said conveyor means;

depositing in succession said removed portions of said continuous first layer on top of said non-removed portions of said continuous first layer.

10. The method of claim 9 further comprising the step of:

feeding after said depositing step a second mixture onto said conveyor means generally between said non-removed portions already present on said conveyor means thereby forming a continuous layer of tobacco comprised of alternating portions of said first mixture and said second mixture, said alternating portions lying adjacent each other to form a continuous layer of alternating portions on said conveyor means.

11. The method of claim 10 further comprising the step of:

trimming said layer of alternating portions, said trimming step assuring that none of said second mixture lies on top of said first mixture and further assuring that said layer of alternating portions on said conveyor means is of proper thickness and equal in thickness.

* * * * *